US009374640B2

(12) United States Patent
Starobin

(10) Patent No.: US 9,374,640 B2
(45) Date of Patent: Jun. 21, 2016

(54) METHOD AND SYSTEM FOR OPTIMIZING CENTER CHANNEL PERFORMANCE IN A SINGLE ENCLOSURE MULTI-ELEMENT LOUDSPEAKER LINE ARRAY

(71) Applicant: Bradley M. Starobin, Baltimore, MD (US)

(72) Inventor: Bradley M. Starobin, Baltimore, MD (US)

( * ) Notice: Subject to any disclaimer, the term of this patent is extended or adjusted under 35 U.S.C. 154(b) by 42 days.

(21) Appl. No.: 14/563,508

(22) Filed: Dec. 8, 2014

(65) Prior Publication Data

US 2015/0189439 A1 Jul. 2, 2015

Related U.S. Application Data

(60) Provisional application No. 61/912,941, filed on Dec. 6, 2013.

(51) Int. Cl.

| | |
|---|---|
| ***H04R 5/02*** | (2006.01) |
| ***H04R 3/12*** | (2006.01) |
| *H04R 5/04* | (2006.01) |
| *H04S 3/00* | (2006.01) |

(52) U.S. Cl.

CPC .. *H04R 3/12* (2013.01); *H04R 5/04* (2013.01); *H04S 3/008* (2013.01); *H04S 2400/03* (2013.01); *H04S 2400/05* (2013.01)

(58) Field of Classification Search

None

See application file for complete search history.

(56) References Cited

U.S. PATENT DOCUMENTS

| | | | | |
|---|---|---|---|---|
| 2004/0175001 | A1* | 9/2004 | Sakagami | H04S 3/002 381/27 |
| 2005/0089181 | A1* | 4/2005 | Polk, Jr. | H04S 3/002 381/300 |
| 2005/0226425 | A1* | 10/2005 | Polk, Jr. | H04S 3/002 381/17 |
| 2012/0308065 | A1* | 12/2012 | Padalino | H04R 1/028 381/335 |

* cited by examiner

*Primary Examiner* — Wayne Young
*Assistant Examiner* — Mark Fischer
(74) *Attorney, Agent, or Firm* — J. Andrew McKinney, Jr.; McKinney & Associates, LLC.

(57) ABSTRACT

A multi-element single enclosure loudspeaker system uses all of the available driver elements in a linear array of loudspeaker drivers for purposes of reproducing center channel program material, whether discrete within a multichannel mix (such as Dolby Digital 5.1™) or derived from a 2-channel mixdown via any appropriate means (such as SRS™ or Dolby ProLogic™ algorithms), in a manner that provides optimized intelligibility of dialog, improved overall clarity, natural timbre and dynamics of music or other effects and wide bandwidth for a wide range of seating/viewing locations for (domestic) home theater environments.

20 Claims, 11 Drawing Sheets

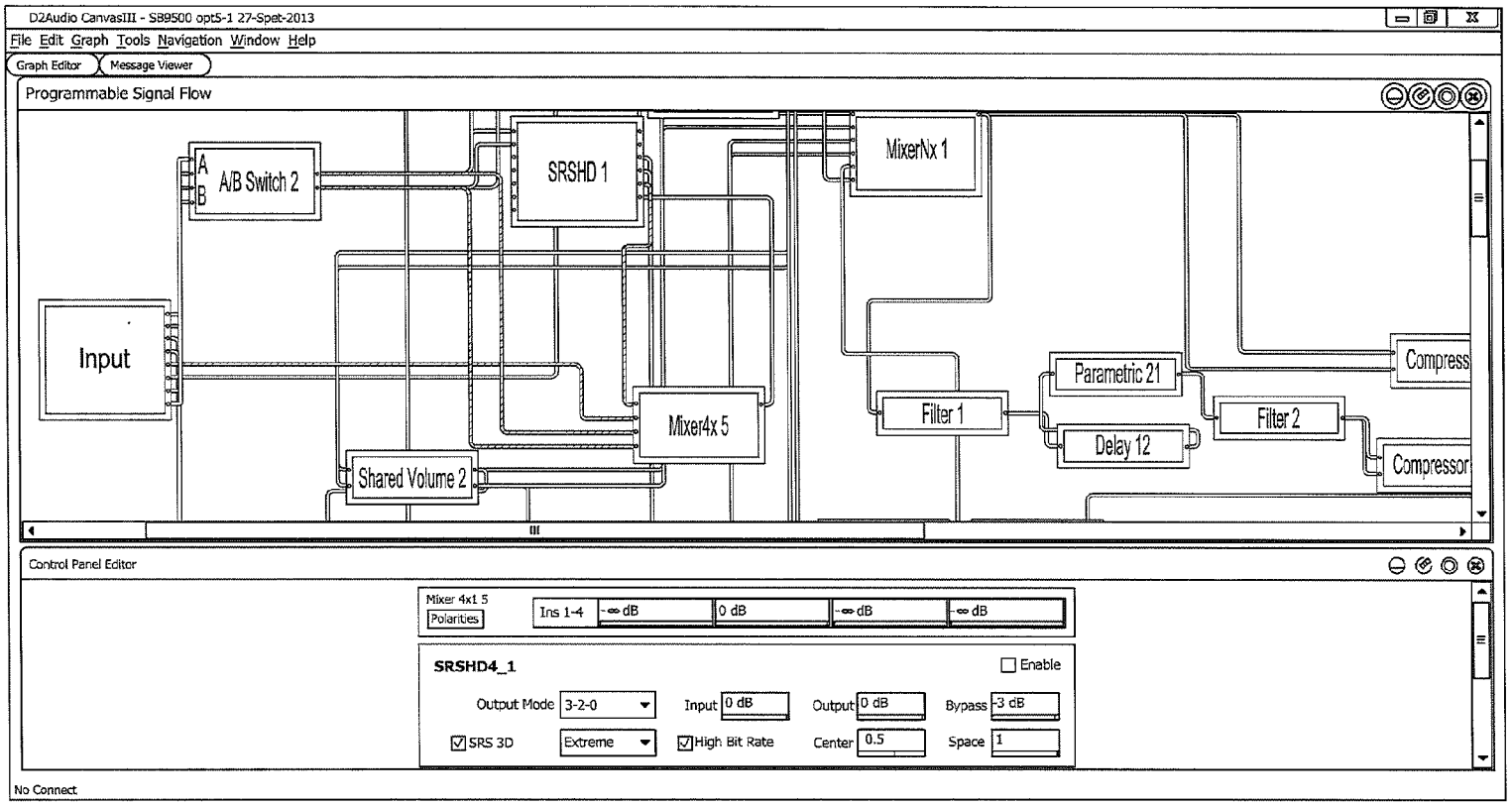

In the screen shot of the D2 DAE6 DSP signal flow for the applicant's Polk Audio SurroundBar 9500™ shown above, center channel program is selected or derived within Mixer 4x1_5. The four inputs of this mixer reflect respectively (1) SRS derived center channel and (2) discrete center channel program from the Dolby Digital or DTS decoder while (3) and (4) are respectively the Left and Right channel of a two-channel stereo source.

FIG. 7

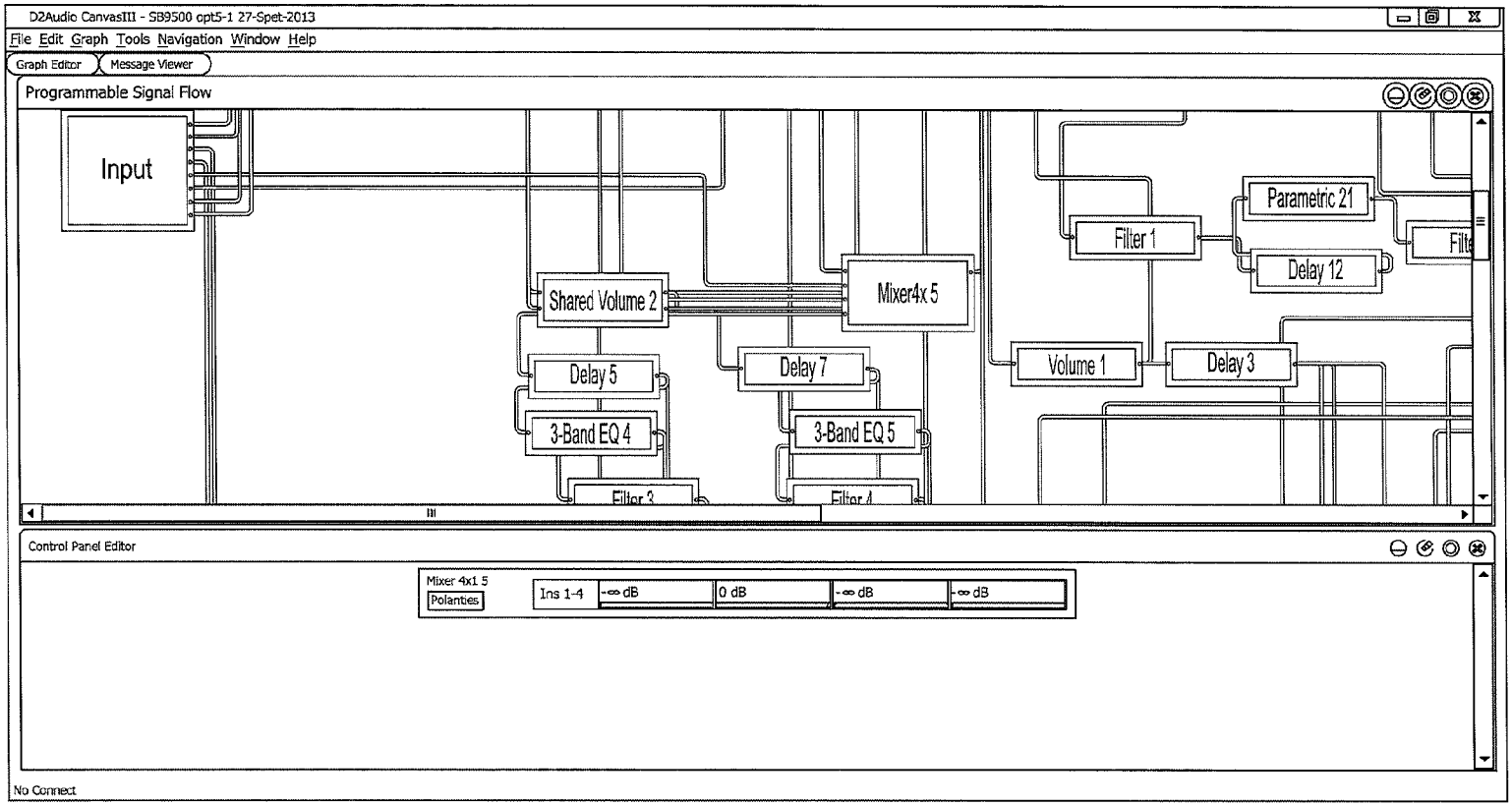

The particular settings of Mixer 4x1 5, shown in this Fig. 8, reflect a multichannel discrete program (Dolby Digital or DTS) for which the SRSHD4_1 DSP block is disabled ("Enable" is unchecked). Note that all of the inputs of Mixer 4x1_5 except for (2) are set to "-∞" (negative infinity), meaning that the output of this mixer is input (2), discrete Dolby Digital or DTS decoded center channel program. Further, note that input 3's setting is OdB, meaning that it is passed through this mixer at full-gain (unattenuated).

FIG. 8

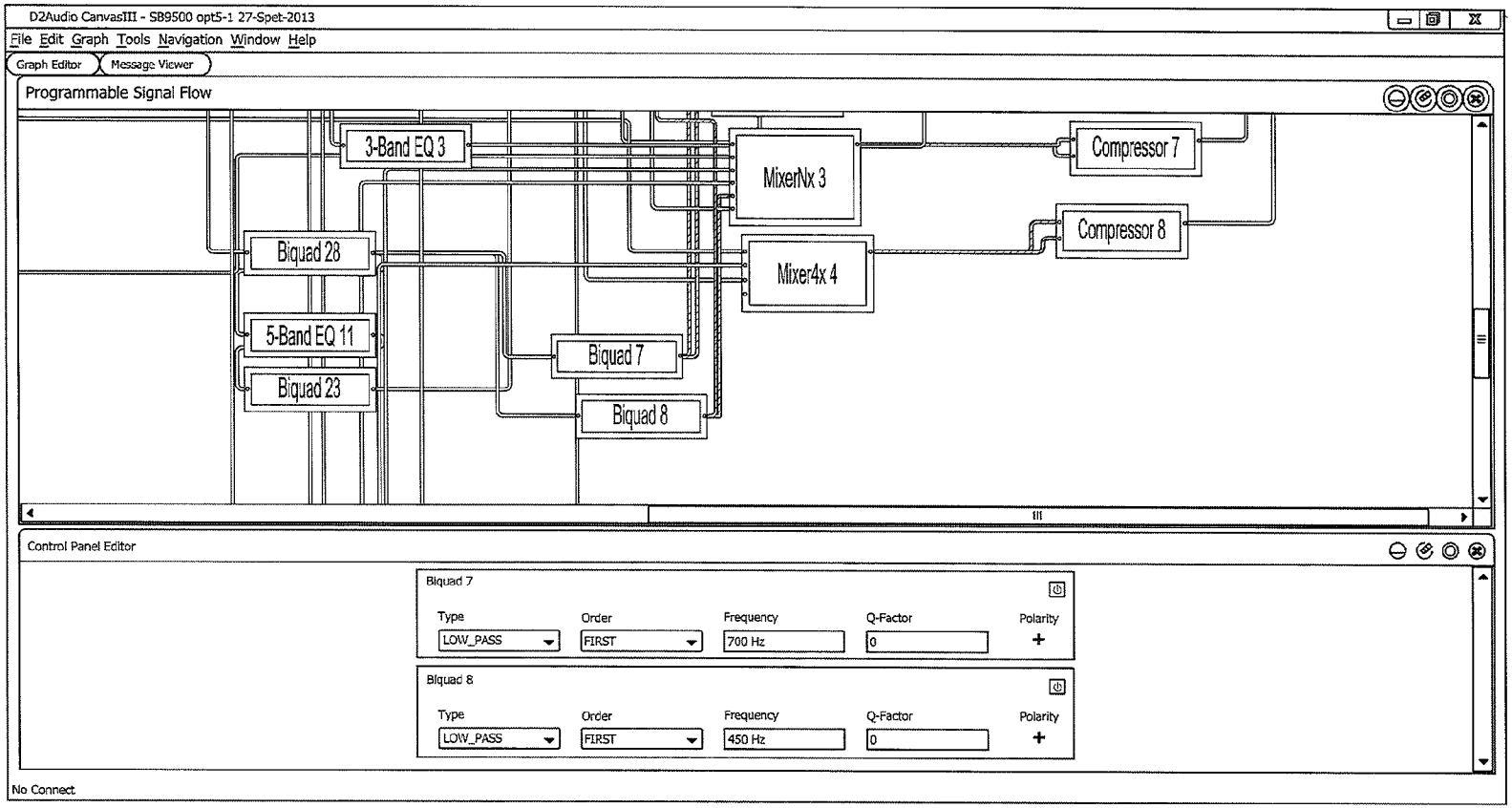

In the screen shot of the D2 DAE6 DSP signal flow for the applicant's Polk Audio SurroundBar 9500™ shown in Fig. 10, a portion of the center channel magnitude tapering applied to the outer two midbass drivers is shown. Biquad 8 is a first order (6dB/octave) lowpass filter applied to the two outermost midbass drivers (e.g., to provide BPF1, of Fig. 6B) while Biquad 7 is a similar filter, set to 700Hz (e.g., to provide BPF2, of Fig. 6B), that operates on the two neighboring drivers positioned more inward (closer to the center). Note that Mixer Nx1_3 (6 input channel →1 output channel) applies to the outermost righthand midbass driver and Mixer 4x1_3 (not shown) mixes down the 4 derived signals reproduced by its neighboring midbass driver.

FIG. 10

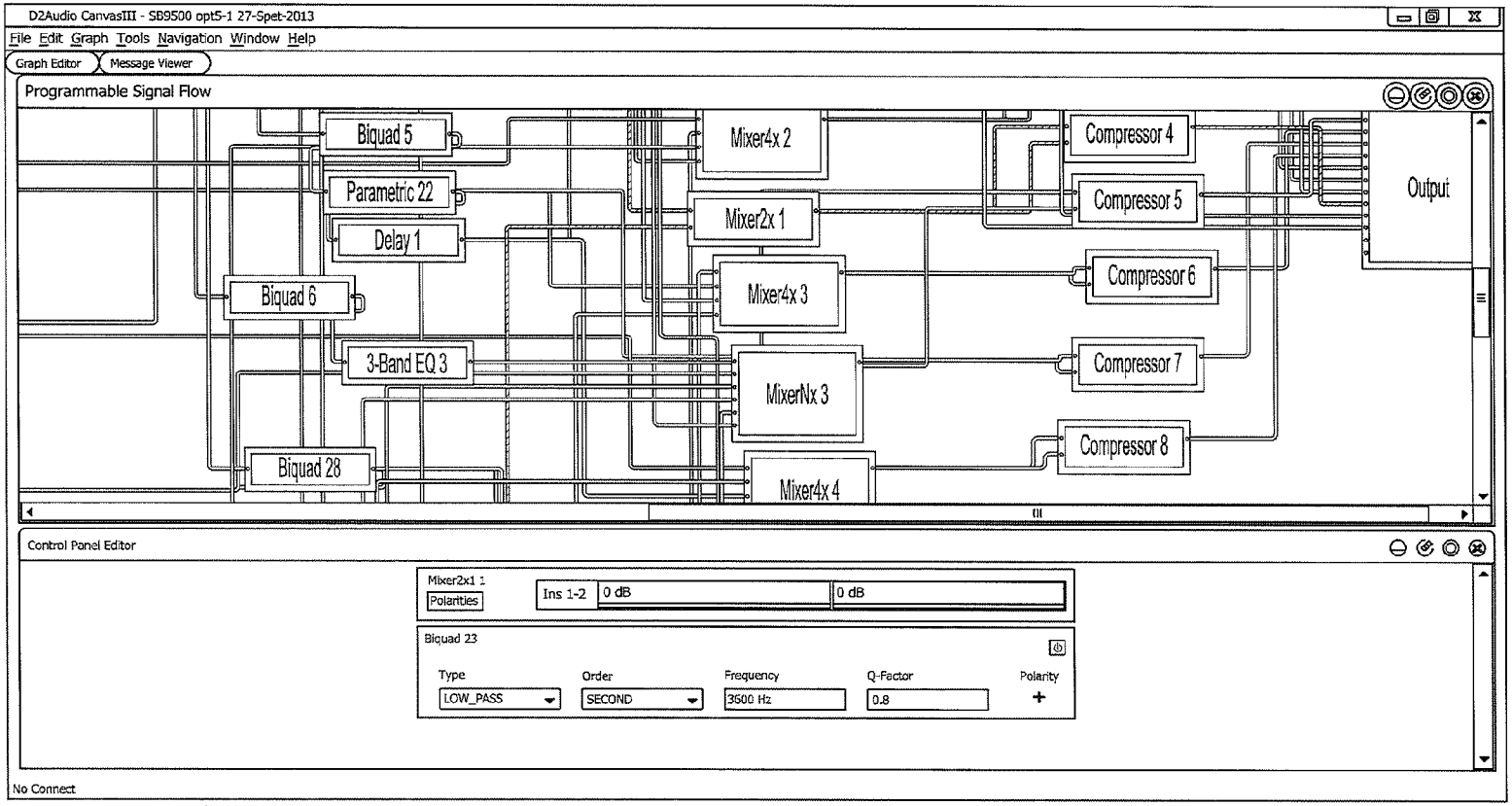

In the screen shot of the D2 DAE6 DSP signal flow for the applicant's Polk Audio SurroundBar 9500™ shown in Fig. 11, the second order low-pass filter (12dB/octave) operating on the center channel program information directed to center-located midbass driver. Note that its nominal low-pass frequency is 3600Hz, substantially higher than the LPF's operating on the outer midbass drivers. Above 3.6kHz the center-located tweeter (high-frequency transducer) operates over the balance of the audible passband up to 20kHz. Note further that Compressor 4, a parametric Dynamic Range Compressor (DRC) is that associated with this particular amplifier output channel (number 8 of the 10 utilized inputs of the Output block's 12 available inputs).

FIG. 11

VOICE

| "VOICE" setting re default (+/- steps) | Vol 1 (center ch vol) setting (re default for input and mode) [dB] | 3-Band Eq 1 Band 2 (center ch PEQ) re default [dB] | Shared Vol 1 (master volume) re current setting [dB] --DD modes corresponding to data registers 0x00, 02, 04, 06 + 2ch PCM, AUX, BT) | Shared Vol 1 (master volume) re current setting [dB] -- DD modes corresponding to data registers 0x01, 03, 05, 07 | example -- default Vol1 = -3dB; Vol 1 setting [dB] | example -- default 3-Band EQ1 , Band 2 =+1.0dB [dB] | example (derived Center Ch modes such as PCM) -- Shared Vol 1 = - 12dB [dB] | example (discrete center ch DD mode such as 5.1) -- Shared Vol 1 = -12dB [dB] -- |
|---|---|---|---|---|---|---|---|---|
| -1 (min) | -3.0 | -2.0 | 0.0 | 0.0 | -6.0 | -1.0 | -12.0 | -12.0 |
| 0 (default) | 0.0 | 0.0 | 0.0 | 0.0 | -3.0 | 1.0 | -12.0 | -12.0 |
| +1 | 1.5 | 1.0 | -1.0 | 0.0 | -1.5 | 2.0 | -13.0 | -12.0 |
| +2 | 3.0 | 2.0 | -2.0 | 0.0 | 0.0 | 3.0 | -14.0 | -12.0 |
| +3 | 6.0 | 3.0 | -4.5 | 0.0 | 3.0 | 4.0 | -16.5 | -12.0 |
| +4 | 9.0 | 3.0 | -6.0 | 0.0 | 6.0 | 4.0 | -18.0 | -12.0 |
| +5 (max) | 12.0 | 3.0 | -8.0 | 0.0 | 9.0 | 4.0 | -20.0 | -12.0 |

example of DSP settings for "VOICE ADJUST" embodiment of present invention

Note: "3-Band Eq 1 Band 2" shall be comprised of a single band EQ boost/cut of varying magnitude; in one embodiment it varies between -2dB (cut) through "flat" (OdB) and up to +3.0dB (boost).

FIG. 12

Simplified schematic of auto suppression of front and surround channels for "sports" mode

METHOD AND SYSTEM FOR OPTIMIZING CENTER CHANNEL PERFORMANCE IN A SINGLE ENCLOSURE MULTI-ELEMENT LOUDSPEAKER LINE ARRAY

PRIORITY CLAIM AND REFERENCE TO RELATED APPLICATIONS

This application claims the benefit of U.S. Provisional Patent Application No. 61/912,941, filed Dec. 6, 2013 and entitled "Method and System for Optimizing Center Channel Performance in a Single Enclosure Multi-Element Loudspeaker Line Array", the entire disclosure of which is hereby incorporated herein by reference. The subject matter of this invention is also related to the following commonly owned applications: Ser. No. 10/692,692, filed Oct. 27, 2003 now U.S. Pat. No. 6,937,737, and Ser. No. 11/147,447, filed Jun. 8, 2005 now U.S. Pat. No. 7,231,053, the entireties of which are incorporated herein by reference.

BACKGROUND OF THE INVENTION

1. Field of the Invention

The present invention relates to reproduction of sound in multichannel systems generically known as "surround-sound" systems and more specifically to the application of psychoacoustic and acoustic principles in the design of a multi-driver single enclosure loudspeaker system for enhancing center channel sound localization and intelligibility from a single enclosure "surround-sound" loudspeaker system located in front of a listening space.

2. Discussion of the Prior Art

Surround-sound or home theater loudspeaker systems are configured for use with standardized home theater audio systems which include a plurality of playback channels, each typically served by an amplifier and a loudspeaker. In Dolby™ home theater audio playback systems, there are typically five channels of substantially full range material plus a subwoofer channel configured to reproduce band-limited low frequency material. The five substantially full range channels in a Dolby Digital 5.1™ system are typically, center, left front, right front, left surround and right surround. The center channel is typically positioned in a home theater system directly over or under the video display and that channel used by content creators for most of the dialog, which has the desirable effect of making reproduced dialog sound as if it were emanating from the display.

Unfortunately, when typical surround sound loudspeaker systems are installed in listener's homes, setup problems are encountered and many users struggle with speaker placement, component connections and related complications. In response, many listeners have turned to "soundbar" style home theater loudspeaker systems which incorporate at least left, center and right channels into a single enclosure configured for use near the user's video display.

These soundbar style single enclosure loudspeaker systems are simpler to install and connect, but provide unsatisfactory performance for listeners who listen from listening positions arrayed in a listening space. There is often only one position directly in front of the center of the soundbar which provides acceptable center-channel performance, meaning that the listener can actually hear dialog, localize the center channel and the dialog as appearing to emanate from the display and appreciate a high fidelity, natural dynamic quality to that portion of the program material rendered in the center channel. Listeners positioned elsewhere in the listening space must suffer with significantly poorer center channel dialog intelligibility and localization, and those other listeners usually notice that the center channel sound they hear is difficult to understand, not easy to localize, and distorted or compressed, especially if the audio program material is dynamic (e.g., with explosions or other loud effects).

The typical soundbar loudspeaker (by definition, multi-element, single-enclosure) thus does a very poor job of reproducing center channel program material for those poorly positioned listeners, whether discrete within a multichannel mix (such as Dolby Digital 5.1) or derived from a 2-channel mixdown via any appropriate means (such as SRS or Dolby ProLogic algorithms), and so experience poor intelligibility of dialog, a lack of overall clarity, unnatural timbre and dynamics of music or other effects and this poor performance is experienced and appreciated for most of the listener seating and viewing locations in typical (domestic) home theater environments.

There is a need, therefore, for a loudspeaker system and method for reproducing home theater audio program material and especially center channel dialog material for listeners arrayed within a realistically large seating space, where dialog for all listeners is intelligible, natural sounding and localized to the center of the loudspeaker, regardless of each listener's location relative to the loudspeaker within the listening space.

SUMMARY OF THE INVENTION

Accordingly, it is an object of the present invention to overcome the above mentioned difficulties by providing a home theater loudspeaker system with significantly improved center channel fidelity and intelligibility. The system of the present invention preferably includes a linear array of loudspeaker drivers which are generally placed horizontally, above or below a substantially rectangular display, with the center of the loudspeaker array being aligned with the center of the display.

In accordance with the present invention, a soundbar type loudspeaker is configured with a plurality of (e.g. 3-9) loudspeaker drivers driven with signals processed to optimally reproduce center channel program material for a listener occupying a listening space, generally in front of the display. The driver elements are aligned along a substantially horizontal axis to form a line array and the signal for each loudspeaker driver is appropriately band limited to provide an acoustically summed (or superposed) collective acoustic output. The combined output from the array is generally aimed at the listening space and provides sound with dialog which highly intelligible, so that sound which the user perceives to come generally from the display is natural and substantially localized to the center of the display and the loudspeaker array, regardless of the listener's location relative to the loudspeaker within the listening space.

The loudspeaker system of the present invention uses all of the available driver elements in a soundbar loudspeaker (by definition, multi-element, single-enclosure) for purposes of reproducing center channel program material, whether discrete within a multichannel mix (such as Dolby Digital 5.1™) or derived from a 2-channel mixdown via any appropriate means (such as SRS™ or Dolby ProLogic™ algorithms), in a manner that provides optimized intelligibility of dialog, overall clarity, natural timbre and dynamics of music or other effects and wide bandwidth that may be appreciated as such for a wide range of seating/viewing locations for (domestic) home theater environments.

In accordance with the present invention, a single enclosure loudspeaker system is configured to provide dynamic range, system clarity, and bass response of a high-performance separate component home theater system with the ease of hookup and use consumers expect of a powered soundbar system. Specifically this includes:

- Providing superior center channel intelligibility and off-axis enjoyment.
- Playing all 5.1 audio channels from DTS™ or Dolby Digital™ sources augmented by signal processing designed to create a broad, deep and tall sound field that extends along the side walls and overhead with a high degree of specificity.
- Providing an 80 Hz high pass with 80 Hz low pass of a subwoofer loudspeaker system. This is normal for component home theater systems and results in minimal localization of the sub and superior blending between both speakers.

The exemplary system consists of a long (e.g., 44⅝" long) amplified bar enclosure incorporating five 2½" convex drivers and three ½" silk dome tweeters, each driven by a dedicated amplifier channel. The powered wireless subwoofer has an MDF cabinet with a down-firing 8" long throw composite cone with rubber surround. Crossover high and low pass filters are implemented electronically with no passive componentry in the signal path. This reduces phase shift and lowers distortion inherent in all passive crossover networks and the dedicated amplifiers for each of the eight drivers provide greater dynamic range, adding an effortless character that is appreciated as an enhanced sense of realism. Each channel's input signal is processed through a Digital Signal Processing ("DSP") engine programmed with 58 discrete DSP blocks for delay, frequency shaping, crossover points, signal mixing and parametric compression. Amplitude smoothing addresses even minor irregularities of all eight active drive units. Center channel and the remaining Left, Right and Surround channels are actively controlled to provide strong image localization cues and a greater sense of ambience and space.

All five of the mid-bass 2½" drive units contribute to the center channel performance in an amplitude-tapered cascaded array design now called the Optimized Center Array "OCA" system and method. The OCA system includes a novel method for band-limiting each driver's contribution to the overall sound field. The system progressively low-passes the driver array's outer and inner driver pairs to mitigate undesirable constructive and destructive interference that otherwise would result in off-axis frequency response irregularities (i.e., comb-filtering "venetian blind" effects which alter vocal reproduction for different seating positions). The OCA system of the present invention controls off-axis amplitude response by appropriately limiting each mid-bass driver's passband for minimal interference for off-axis seating locations as follows: outer and inner driver pairs reproduce center channel information from 80-450 Hz and 80-700 Hz respectively while only the center driver plays center channel program material through the upper midrange all the way up to its crossover point with the center tweeter (80 Hz-4 kHz). Meanwhile, the outer tweeters are also employed as "super tweeters" (6 kHz-20 kHz) for center channel material in addition to serving their primary duties in the reproduction of Front (FL/FR) and Surround (SL/SR) channels. To avoid unwanted localization, the outer tweeters' acoustic output is appropriately delayed.

In accordance with the present invention, OCA processing results in an unprecedented clarity and intelligibility of center channel information over a very wide listening area. Even listeners far to the side hear vocal reproduction and other center information with similar tonal balance to on-axis listeners. Everyone hears natural sounding, clear dialog, musical instruments and center-channel effects that are firmly anchored to the screen.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE FIGURES

FIG. 7 is a screen shot illustrating DSP signal flow in an embodiment of the OCA system and method of the present invention.

FIG. 8 is another screen shot illustrating DSP signal flow in an embodiment of the OCA system and method of the present invention.

FIG. 10 is another screen shot illustrating DSP signal flow in an embodiment of the OCA system and method of the present invention.

FIG. 11 is another screen shot illustrating DSP signal flow in an embodiment of the OCA system and method of the present invention.

FIG. 12 is a screen shot illustrating exemplary DSP settings for a user controllable "VOICE ADJUST" mode available with another embodiment of present invention.

DESCRIPTION OF THE PREFERRED EMBODIMENT

Turning now to FIGS. 1-13, a multi-channel single enclosure loudspeaker system 100 is configured for use with a method for optimizing Center Channel performance from a single enclosure multi-element loudspeaker line array 120, in accordance with the present invention. in accordance with the present invention.

Figure 1:
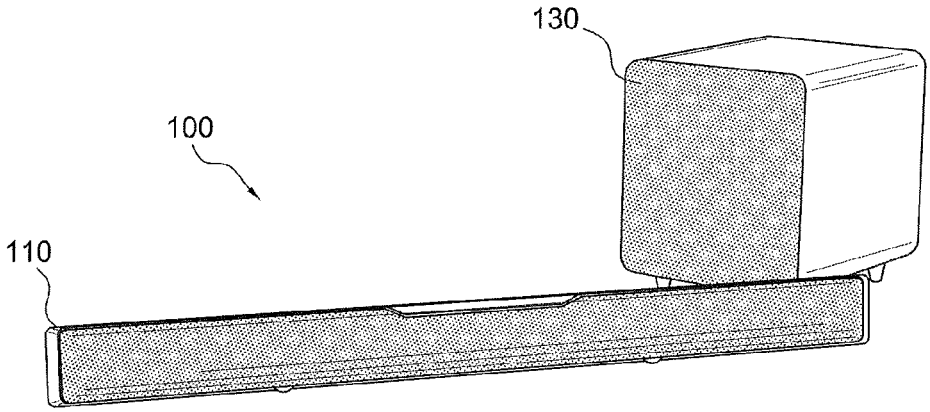
FIG. 1 is a perspective view illustrating a single enclosure multi-element loudspeaker line array and a multi-channel single enclosure loudspeaker system, configured for use with a separate subwoofer, in accordance with the present invention.
Figure 5:
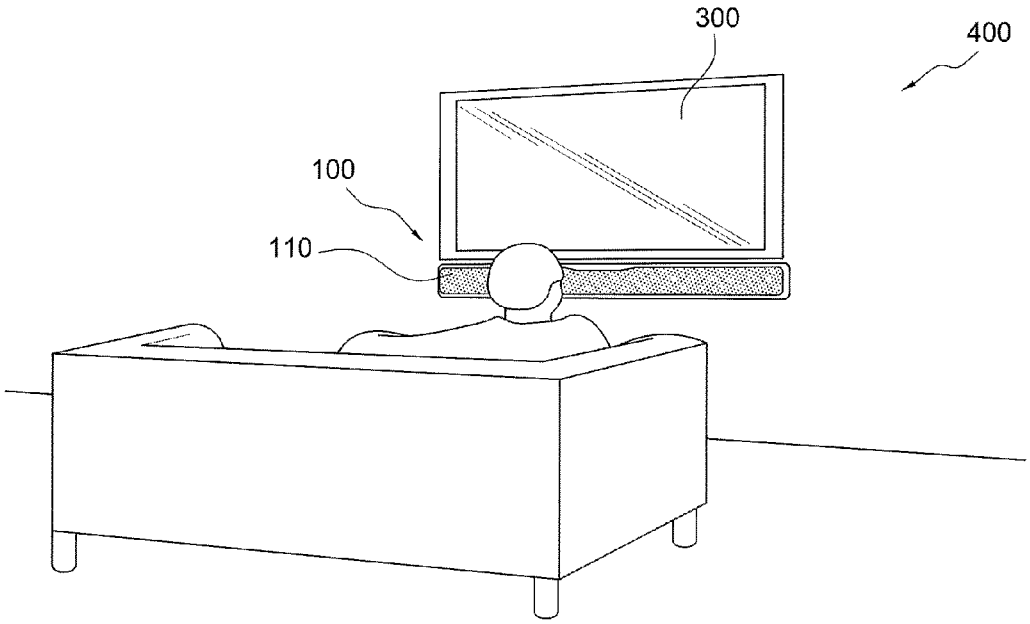
FIG. 5 illustrates the listening room and system in accordance with the method for optimizing Center Channel performance from the loudspeaker system of FIGS. 1-4, in accordance with the present invention.

Referring first to FIGS. 1 and 5, in a traditional home theater listening space 400 the single soundbar enclosure 110 is configured to be placed near a video display 300, generally in front of the video display 300 and enclosure 110 is positioned such that line array 120 is aligned in a substantially horizontal orientation which is preferably proximate to and substantially parallel with the bottom or top edge of the display's surface.

Figure 2:
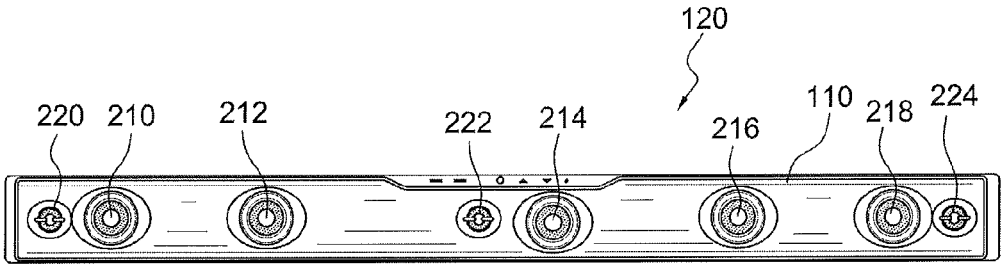
FIG. 2 illustrates the front of the single enclosure multi-element loudspeaker line array and single enclosure loudspeaker system of FIG. 1, in accordance with the present invention.
Figure 3:
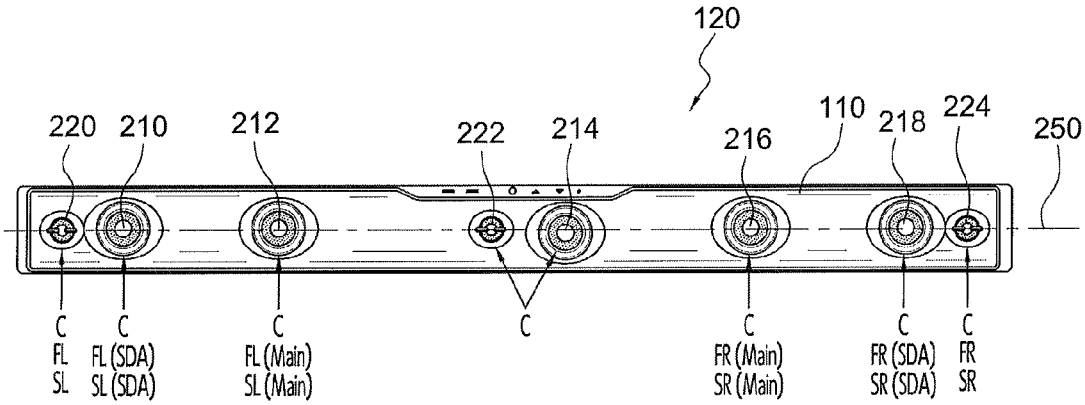
FIG. 3 is a diagram illustrating the nomenclature designating the individual loudspeaker drivers in the loudspeaker system of FIGS. 1 and 2, in accordance with the present invention.
Figure 4:
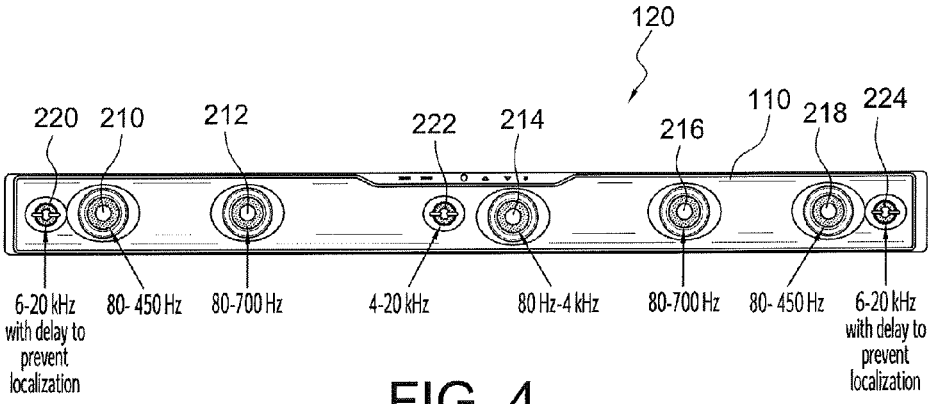
FIG. 4 is a diagram illustrating the method for driving the individual loudspeaker drivers to optimize Center Channel performance from the loudspeaker system of FIGS. 1-3, in accordance with the present invention.

FIGS. 2-4 illustrate an exemplary embodiment showing the alignment of the eight loudspeaker drivers or elements, along central axis and in system 100, and the signal for each loudspeaker driver is appropriately band limited to provide an acoustically summed (or superposed) collective acoustic output of the array within the seating space 400 which is highly intelligible, natural sounding and localized to the center of the loudspeaker array 110, regardless of the listener's location relative to the loudspeaker enclosure 110 within listening space 400.

The loudspeaker system of the present invention 100 uses all of the available driver elements the soundbar loudspeaker (by definition, multi-element, single-enclosure) for purposes of reproducing center channel program material, whether discrete within a multichannel mix (such as Dolby Digital 5.1) or derived from a 2-channel mixdown via any appropriate means (such as SRS or Dolby ProLogic algorithms), in a manner that provides optimized intelligibility of dialog, overall clarity, natural timbre and dynamics of music or other effects and wide bandwidth that may be appreciated as such for a wide range of seating/viewing locations for (domestic) home theater environments.

In accordance with the present invention, single enclosure loudspeaker array 120 is configured to provide superior center channel intelligibility and off-axis enjoyment while playing all 5.1 audio channels from DTS™ or Dolby Digital™ sources augmented by signal processing designed to create a broad, deep and tall sound field that extends along the side walls and overhead with a high degree of specificity.

The exemplary array 120 consists of a 44⅝" amplified bar enclosure 110 which supports five (5) 2½" convex drivers 210, 212, 214, 216 and 218 and three ½" silk dome tweeters 220, 222 and 224. The powered wireless subwoofer 130 has an MDF cabinet with a down-firing 8" long throw composite cone with rubber surround. Each of the five convex mid-bass drivers 210, 212, 214, 216 and 218 and three tweeters 220, 222 and 224 is driven by a dedicated amplifier channel.

Figure 6A:
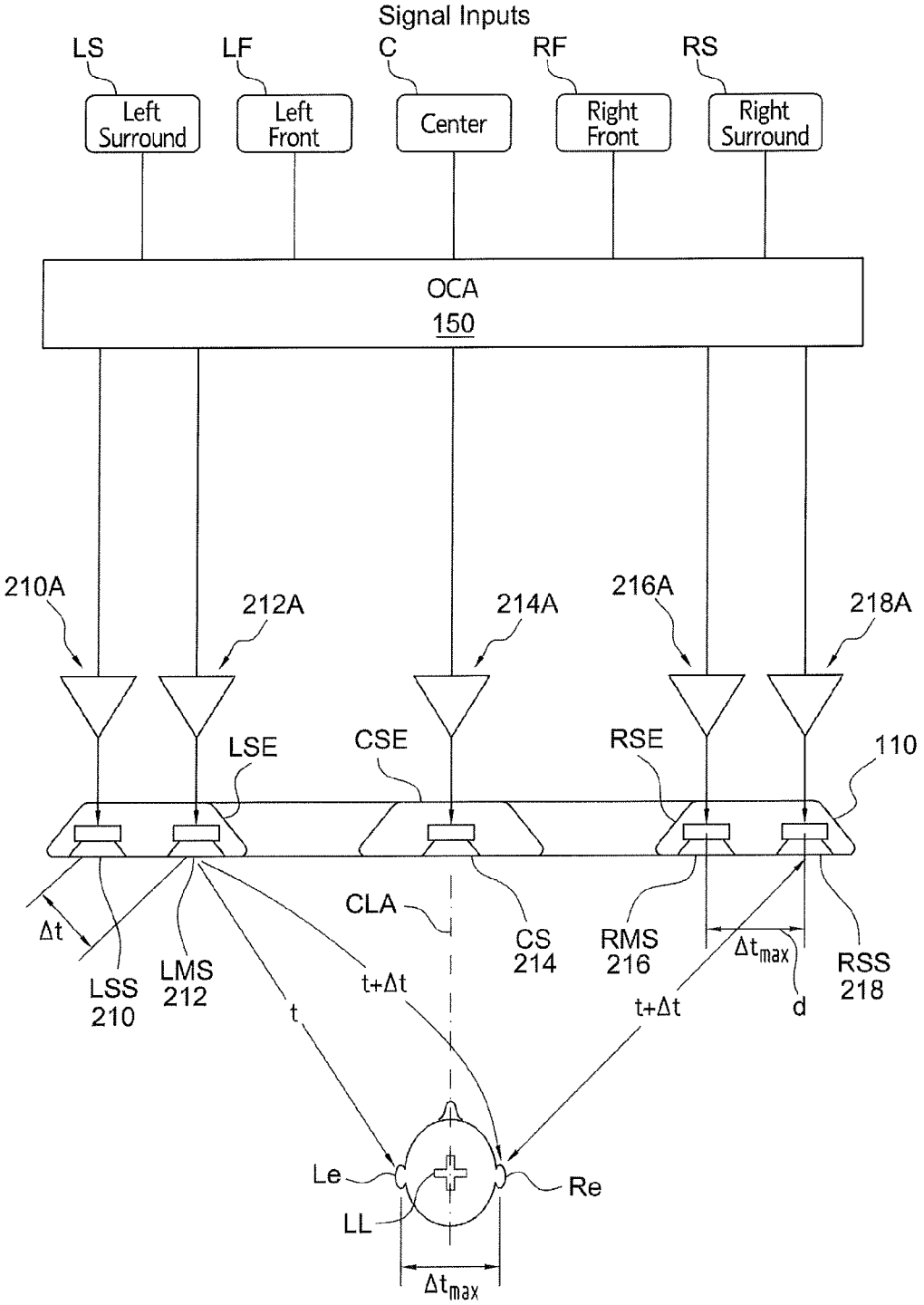
FIG. 6A is a diagram illustrating the signal flow through the signal modification and combination processor and dedicated amplifiers configured for optimizing Center Channel performance from a single enclosure multi-element loudspeaker line array and a multi-channel single enclosure loudspeaker system (e.g., as shown in FIGS. 1-5), in accordance with the present invention.

In accordance with the present invention, each driver is controlled by an active crossover or signal modification and combination system 150 identified as the OCA system 150 which implements selected signal processes digitally, as illustrated diagrammatically in FIG. 6A (which illustrates signal flow to the mid-bass drivers 210, 212, 214, 216 and 218, with tweeters 220, 222 and 224 omitted from this view, for simplicity's sake). High and low pass filters are implemented electronically with no passive componentry in the signal path between the source and the drivers. This reduces phase shift and lowers distortion inherent in all passive crossover networks and individual amplifiers (e.g., 210A, 212A, 214A, 216A and 218A) provide greater dynamic range, adding an effortless character that may be appreciated as an enhanced sense of realism. Each channel's input signal is processed through Digital Signal Processing ("DSP") engine OCA 150 which is programmed with 58 discrete DSP blocks for delay, frequency shaping, crossover points, signal mixing and parametric compression. Amplitude smoothing is configurable to address minor irregularities of all active drive units. The center channel CS, left main channel LMS, right main channel RMS, left surround channel LSS, and right surround channel RSS are actively controlled via programming in OCA 150 to provide strong image localization cues and a greater sense of ambience and space.

All five of the 2½" drive units 210, 212, 214, 216 and 218 contribute to the center channel performance in an amplitude-tapered cascaded array design now called the Optimized Center Array "OCA" system 150, in accordance with the method of the present invention. OCA system 150 progressively low-passes the outer and inner driver pairs (see FIG. 4) to mitigate undesirable constructive and destructive interference that otherwise would result in off-axis frequency response irregularities which would otherwise cause the unwanted comb-filtering "venetian blind" effect which alters vocal reproduction for different seating positions. The OCA processing in system 100 controls off-axis amplitude response by appropriately limiting each mid-bass driver's passband for minimal interference for off-axis seating locations as follows: outer and inner driver pairs reproduce center channel information from 80-450 Hz and 80-700 Hz respectively while only the center driver plays center channel program material through the upper midrange all the way up to its crossover point with the center tweeter (80 Hz-4 kHz). Meanwhile, the outer tweeters are also employed as "super tweeters" (6 kHz—20 kHz) for center channel material in addition to serving their primary duties in the reproduction of Front (FL/FR) and Surround (SL/SR) channels. To avoid unwanted localization, in processing the center channel signal component for input to the outer tweeters 220, 224, those outer tweeters' acoustic outputs are delayed by one millisecond, as compared to the center channel signal provided to center tweeter 222.

In accordance with the present invention, OCA processing results in an unprecedented clarity and intelligibility of center channel information over a very wide listening area. Even listeners far to the side of listening area 400 hear vocal reproduction and other center information with similar tonal balance to on-axis listeners. Everyone hears natural sounding, clear dialog, musical instruments and center-channel effects that are firmly anchored to the screen.

Returning to the diagram of FIG. 6A, multi-channel single enclosure loudspeaker system 100 includes the multi-element loudspeaker line array 120 with, in the illustrated embodiment, LSS mid-bass driver 210, LMS driver 212, CS driver 214, RMS mid-bass driver 216 and RSS mid-bass driver 218. Loudspeaker system 100 comprises an audio reproduction system configured with active crossover or signal modification and combination system 150 (or OCA system 150) with signal inputs for a first audio input signal LS, a second audio input signal LF, a third audio input signal RF, a fourth audio input signal RS and a fifth (center channel) audio input signal C. Left main speaker 212 and a right main speaker 216 are disposed respectively at left and right main speaker locations spaced along a speaker array axis 250 (as best seen in FIG. 3) defined as a line passing through said left and right main speaker locations, with a listening area comprising the general area in front of the left and right main speaker locations, so that the left main speaker location lies to the left and the right main speaker location lies to the right when viewed from the listening area. The left main speaker 212 and right main speaker 216 reproduce sound associated with signals received by said left and right main speakers, and left sub-speaker 210 and right sub-speaker 218 are laterally disposed respectively at left and right sub-speaker locations which lie approximately on the speaker axis 250 such that the left and right sub-speaker locations as viewed from the listening area are located to the left and right respectively of the respective left and right main speaker locations. Center front speaker or mid-bass driver 214 is located between the left and right main speaker locations at a midpoint of the speaker array axis, preferably centered on transverse central listening axis CLA, and center front speaker 214 reproduces sound associated with signals received by it from the signal modification and combination OCA system 150 which transmits the fifth (center) audio input signal C to center front speaker 214 so that sound reproduced by system 100 associated with the fifth (center) audio input signal is perceived by a listener LL located in the listening area whose head is oriented generally toward the speaker locations to originate from approximately the location of center front speaker 214.

Figure 6B:
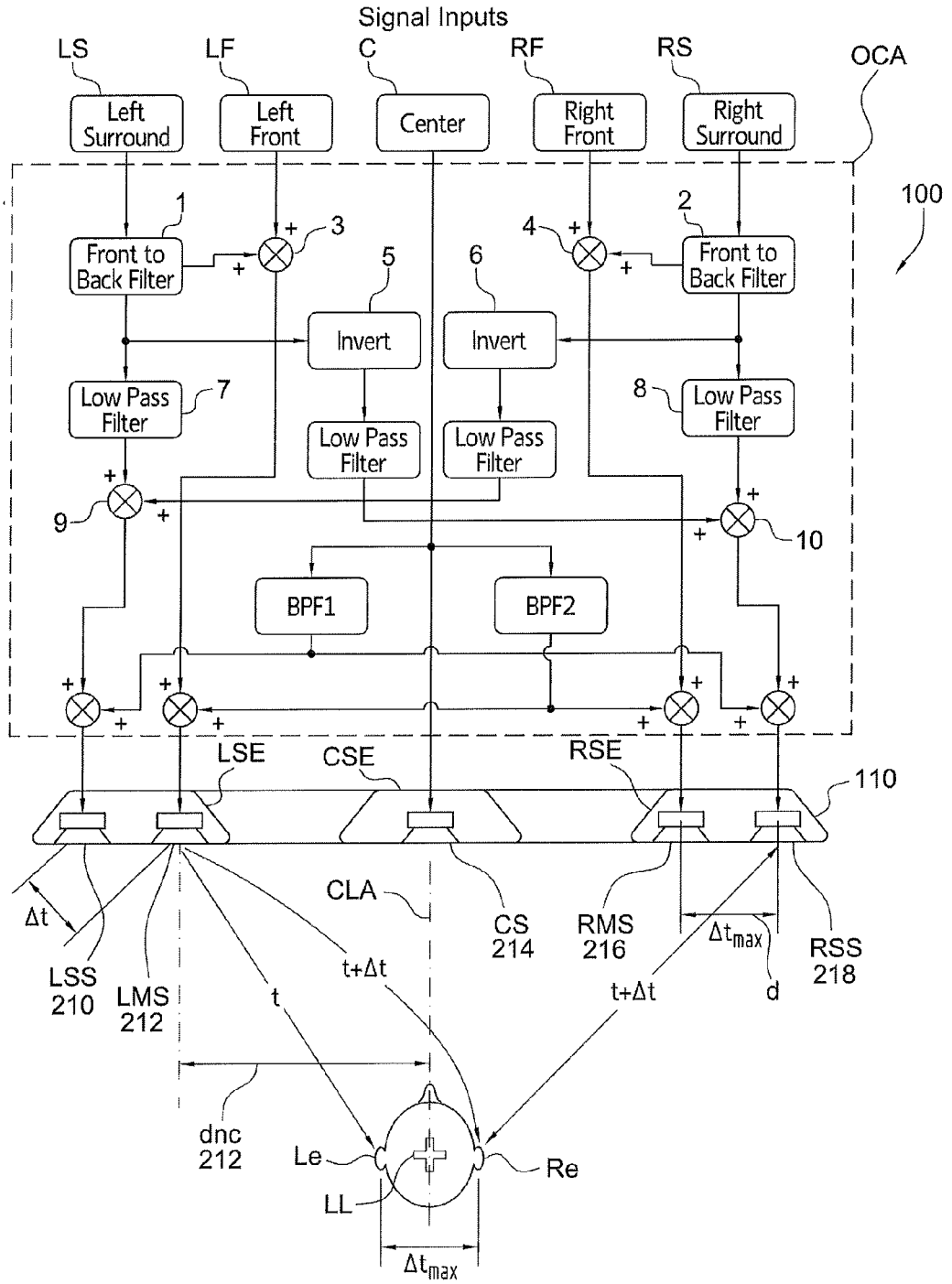
FIG. 6B is a diagram illustrating an exemplary embodiment of signal processing, crossover or signal modification and combination processes for optimizing Center Channel performance from a single enclosure multi-element loudspeaker line array and a multi-channel single enclosure loudspeaker system (e.g., as shown in FIGS. 1-6A), in accordance with the present invention.

Referring now to FIG. 6B, an exemplary embodiment of the system of FIG. 6A is illustrated diagrammatically, but with the dedicated amplifiers (i.e., 210A, 212A, 214A, 216A and 218A) omitted, for simplicity. Signal modification and combination OCA system 150 includes DSP programmed processing for modifying and combining the first LS audio input signal with the second LF audio input signal and transmitting the combination of modified first LS audio input signal and second LF audio input signal to left main speaker 212. OCA system 150 also includes DSP programmed processing for modifying and combining the fourth RS audio input signal with the third RF audio input signal and transmitting the combination of that modified fourth audio input signal and third audio input signal to right main speaker 216 as well as subtracting that modified fourth audio input signal from the modified first audio input signal and transmitting the resulting difference signal to left sub-speaker 218.

Similarly, OCA system 150 also includes DSP programmed processing for subtracting that modified first audio input signal from the modified fourth audio input signal and transmitting the resulting difference signal to the right sub-speaker 218, so that sound reproduced by the system that is associated with said second and third audio input signals LF, RF is perceived by a listener LL to originate from a range of sound locations approximately between the left and right main speakers 212, 216.

OCA system 150 also includes DSP programmed processing for (a) a first bandpass filter BPF1 which modifies the fifth (center channel) audio input signal C and transmits the modified fifth (center channel) audio input signal to left and right sub speakers 210 and 218 and (b) a second bandpass filter BPF2 for modifying the fifth (center channel) audio input signal C and transmitting the modified fifth (center channel) audio input signal to left and right main speakers 212, 216 such that the reproduced sound associated with fifth (center channel) audio input signal C when reproduced by said left and right sub speakers said left and right main speakers and the center front speaker is perceived by a listener LL (located in the listening area whose head is oriented generally toward the speaker locations) to originate from a sound location near the midpoint of the speaker array axis, and on the listener's central axis CLA.

The illustrated embodiment of system 100 shown in FIG. 6B incorporates some features of applicant's commonly owned prior art, namely the SDA™ signal processing technology as described and illustrated in the commonly owned Soundbar system U.S. Pat. No. 6,937,737 mentioned above, the entire disclosure of which is incorporated herein by reference, for purposes of setting forth nomenclature and to provide background material for persons of skill in the art. Adapting that nomenclature to the system of the present invention, it is readily apparent that system 100 may be configured to provide improved center channel performance while optionally providing a modern adaptation of applicant's SDA™ signal processing technology. In accordance with the illustrated embodiment, FIG. 6B shows the general composition of the modified and combined signals transmitted to each speaker where the prime designation, ', denotes that the original audio input signal has been suitably modified by the OCA signal modification and combination means 150. It will be understood that within the scope of the present invention and as shown in FIG. 6B that any suitable means may be employed to achieve the appropriate signal modifications and combinations. In addition and as discussed above, experiments have shown that within the scope of the present invention, many variations to the specific signal modifications herein described function to provide an acceptable center channel enhancement and surround sound illusion from loudspeakers located only in front of the listener. The specific signal modifications described herein are by way of example only and not of limitation.

In the embodiment illustrated in FIG. 6B, left sub-speaker LSS and right sub-speaker RSS are positioned relative to left main speaker LMS and right main speaker RMS and to the listener according to the teachings of U.S. Pat. Nos. 4,489,432; 4,497,064; 4,569,074 and 4,630,298 for the purpose of canceling IAC and producing a realistic acoustic field extending beyond the loudspeaker locations. As discussed in the above-referenced U.S. Patents, the left and right sub-speakers LSS and RSS may be located on a common speaker axis with left and right main speakers LMS and RMS. However, as also discussed in the above-referenced U.S. Pat. No. 4,497,064, the sub-speakers may be placed in any location that produces the correct time delay relative to the respective main speakers for sounds aiming at the listener's ears. As shown in FIG. 6B and discussed in U.S. Pat. Nos. 4,489,432; 4,497,064; and 4,569,074 in the case that the main and sub-speakers are located along a common speaker axis the preferred spacing between the respective main and sub-speakers on each side is approximately equal to the maximum interval sound $\Delta t_{max}$ up to approximately 150% of $\Delta t_{MAX}$ resulting in a corresponding variation in the inter-speaker delay $\Delta f'$ without departing from the spirit and function of the present invention. Applicant's prior art methods (disclosed in U.S. Pat. Nos. 4,489,432; 4,497,064; 4,569,074 and 4,630,298) are capable of creating apparent sound locations in a range of up to approximately 90 degrees left and right of central listening axis CLA in front of the listener from two audio input signals such as are present in a normal stereo recording. In the embodiment of the present invention illustrated in FIG. 6B, front-to-back filters 1 and 2 are selected to transform the frequency response of sound locations in front of the listener to approximate the frequency response at both of the listener's ear drums of sound locations at mirror image locations behind the listener over a defined frequency range. The methods disclosed in U.S. Pat. Nos. 4,489,432; 4,497,064; 4,569,074 and 4,630,298 modified as specified herein and in combination with the aforementioned signal manipulations will therefore create the illusion of sound locations in a range of approximately 90 degrees left and right of the central listening axis behind the listener from left and right surround input signals LS and RS, but with enhanced localization and intelligibility for center channel dialog. As noted above, the fifth audio input signal or center channel signal in a surround sound system C is amplified and input to center channel loudspeaker enclosure CSE which contains at least one center loudspeaker CS or 214. The center signal input C for the center channel is transmitted to center loudspeaker CS. The sounds produced by center loudspeaker CS are perceived by a listener located at the principle listening location LL as originating from the approximate sound location of center loudspeaker CS.

It will be understood by those skilled in the art that in accordance with this and other embodiments of the present invention a surround sound experience from front located loudspeakers may be created using only four audio input signals, so center the channel's output may be synthesized as a derived or phantom center channel, and the presence of a fifth audio input signal, such as the center channel signal typically found in a surround sound system, is optional and not required.

Persons of skill in the art will appreciate that the system and method of the present invention provides a loudspeaker array (e.g., 120) for reproducing discrete or derived center channel information that relies on both magnitude and phase tapering for optimal performance for a known, prescribed seating location. The exemplary application is for single enclosure, multichannel self-powered loudspeaker systems, but other applications are available, and are included within the scope of the present invention.

Magnitude Tapering:

Transducers located furthest from center (e.g., 210, 218) are rolled-off (low-pass filtered) at a relatively low frequency while those located closer to the center of the array (e.g. 212, 216) reproduce progressively higher frequencies in accordance with shorter wavelengths associated with higher "cross-over" frequency. Filtering characteristics such as nominal LPF frequency and slope (e.g. 6, 12, 18 or 24 dB/octave) are selected in accordance with achieving the preferred system magnitude response over a range of listening (measurement) locations, taking into consideration transducer response characteristics and other performance attributes. As a general rule, use of a higher order filter permits correspondingly higher low-pass "crossover" frequencies. While steeper filters more severely restrict out-of-band program material, they do so at the expense of a less forgiving phase response. The relatively benign phase response of low order filters gives rise to a smoother combined magnitude response with other contributing drive elements and as a result, applicant's experiments demonstrate that low order filters are preferred. In the present embodiment, first order (6 dB per octave) low-pass filters on the outer mid-bass drive units (e.g., 210, 218) have been employed (e.g., in BPF1, as shown in FIG. 6B) for this reason.

With such first order filters, nominal roll-off frequency matches that at which the distance between the transducers equals approximately one-half to two-thirds of one acoustic wavelength in a medium of air at an ambient temperature (e.g., 20 degrees Celsius or 68° F.) within which the speed of sound is approximately 343 m/s or 1125 feet/sec. Table 1, below, provides the ratio of (distance from center) to (acoustic wavelength lambda at the respective crossover frequencies) of the outer and inner midbass drivers, which is approximately 50-60%.

TABLE 1

| | outer drivers (400 Hz LPF) | inner drivers (700 Hz LPF) |
|---|---|---|
| acoustic wavelength lambda (in) | 33.75 | 19.29 |
| distance from center of bar ($d_{NC}$) | 18.00 | 11.00 |
| $d_{NC}$/lambda | 53.33% | 57.02% |

Low pass filters on the outer driver pairs are employed to facilitate a favorable acoustic magnitude response for off-axis (non-centered) seating positions. It may be appreciated that the propagation distance between listening location and each mid bass driver off-axis locations varies considerably. By appropriately low-pass filtering the outer drivers, each differences in propagation distance is a relatively small fraction of an acoustic wavelength.

By maintaining a relatively low ratio of propagation distance to acoustic wavelength within each mid-bass driver's passband, the upper bound of which is determined by its nominal low-pass filter frequency, the acoustic magnitude response of system, which may be appreciated to comprise a line array, will be relatively smooth over a range of locations within an acoustic space (e.g., a user's home theater).

Filter Cutoff Frequency Selection

In accordance with the method of the present invention, the center channel signals are filtered using band pass filters BPF1 (for outermost drivers LSS-210, RSS-218) and BPF2 (for inner main drivers LMS-212, RMS-216), and, in the illustrative embodiment, filters BPF1 and BPF2 are effectuated by programming those as features into a DSP circuit OCA 150 as Low Pass Filters having a selected cutoff frequency. The cutoff frequencies for BPF1 and BPF2 were optimized through experimental observations of various prototypes and by analysis of the acoustical requirements of various configurations, the applicant has found that for a given loudspeaker enclosure and driver configuration, the optimum low pass filter frequency is found using the following formula:

$$f(d_{nc})=0.55c/d_{NC} \quad \text{(Eq. 1)}$$

where c is the speed of sound in air and $d_{Nc}$ is the distance of the center of the laterally offset (non-center channel) transducer of interest (e.g. as shown for transducer 212 in FIG. 6B) from the center of the sound bar. Dimensionally, units of c and $d_{Nc}$ need to match so that f's dimensions are in Hz (cycles/sec). Usually one assumes c=343 m/s or 1125 ft/sec, so units of d should be in meters or feet, respectively. Alternatively, the applicant's cutoff frequency computation method could be expressed as $$f(d_{NC})=1125C/d_{NC} \quad \text{(Eq. 2)}$$

where dimensionless constant C is preferably equal to 0.55 but may vary between 0.43 and 0.60 and $d_{NC}$ is the distance, expressed in feet, of the affected non-center channel (inner and outer) transducers from the center of soundbar. Alternatively, $f(d_{NC})=343C/d_{NC}$ when $d_{NC}$ is expressed in meters. As noted above, low order filters (e.g., 1st or $2^{nd}$ order) work best due to the relatively benign nature of their phase vs frequency response for such filters and, in particular, for 2nd order (12 dB/octave) filters relatively low Q, where Q is a filter's damping factor, low Q (Q<=0.707) is best. Of important note, filters whose Q factor is 0.707 are known as Butterworth but in the preferred embodiment, 1st order (6 dB/octave) filters are employed. Note that no damping factor can be specified for 1st order filters (i.e. Q is N/A).

Phase Tapering

There is, as yet, no phase tapering in the prototype or exemplary systems described above and illustrated in FIGS. 1-6B, but if a feature for optimizing performance within a targeted listening space were desired, a user may make beneficial use of a controllable input permitting one to steer the array accordingly using phase tapering (controlled latency) techniques. Depending on the location of the primary listener relative to the loudspeaker system 100, there is some advantage to applying delay for selected signals applied to selected drivers (e.g., outer tweeters) in the array.

DSP Programming

FIGS. 7-11 are screen shots illustrating DSP signal processing programmed into the exemplary embodiment of OCA system 150, in accordance with the present invention. FIG. 7 is, more specifically, a screen shot of the D2 DAE6 DSP signal flow for the applicant's Polk Audio SurroundBar 9500™ system, where a center channel program is selected or derived within Mixer 4×1_5. The four inputs of this mixer reflect respectively (1) SRS derived center channel and (2) discrete center channel program from the Dolby Digital or DTS decoder while (3) and (4) are respectively the Left and Right channel of a two-channel stereo source. Turning to FIG. 8, the particular exemplary settings of Mixer 4×1 5 reflect a multichannel discrete program (Dolby Digital or DTS) for which the SRSHD4_1 DSP block is disabled ("Enable" is unchecked). Note that all of the inputs of Mixer 4×1_5 except for (2) are set to "−∞" (negative infinity), meaning that the output of this mixer is input (2), discrete Dolby Digital or DTS decoded center channel program. Further, note that input 3's setting is 0 dB, meaning that it is passed through this mixer at full-gain (unattenuated).

Figure 9:
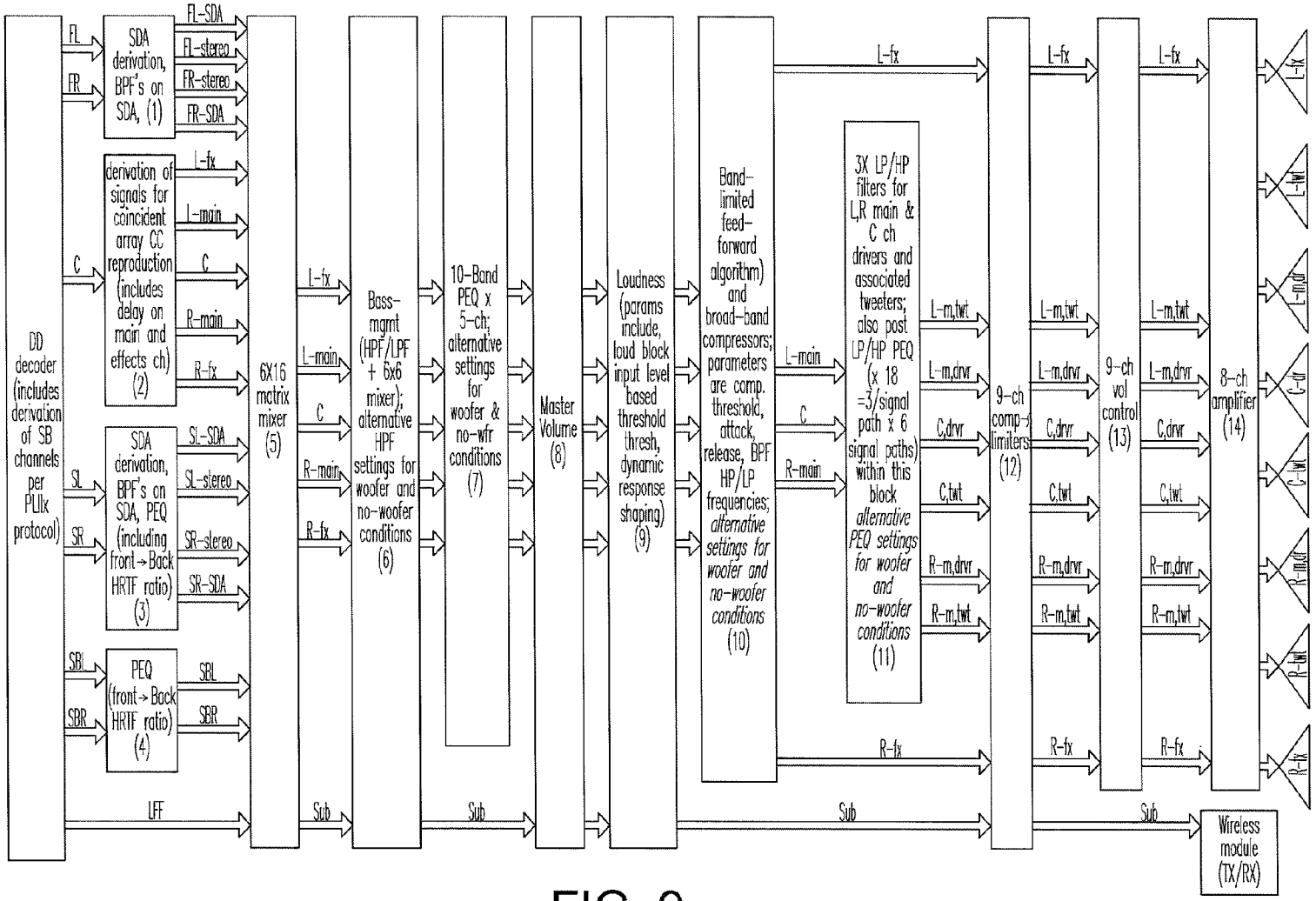
FIG. 9 is a block diagram illustrating the major processing blocks configured to provide the OCA system, in accordance with the method of the present invention.

FIG. 9 is a block diagram including the major processing blocks associated with an exemplary multi-channel single enclosure loudspeaker system configured for use with the method of the present invention (e.g., 100) and was created before having an available DSP/amplifier. Of note is block (2) which addresses center channel processing. In this early prototype's rendition of the processing schemes, the center channel array is called "coincident" to indicate the application of phase (delay) tapering as a means of emulating the favorable performance characteristics of an acoustic point source.

FIG. 10 is a screen shot of the D2 DAE6 DSP signal flow for the applicant's Polk Audio SurroundBar 9500™ and a portion of the center channel magnitude tapering applied to the outer two midbass drivers is shown. "Biquad 8" is a first order (6 dB/octave) lowpass filter applied to the two outermost midbass drivers (e.g., to provide BPF1, of FIG. 6B for drivers 210 and 218) while "Biquad 7" is a similar filter, set to 700 Hz (e.g., to provide BPF2, of FIG. 6B), that operates on the two neighboring drivers positioned more inward (e.g., for drivers 212 and 216, closer to the center). Note that Mixer Nx1_3 (6 input channel to 1 output channel) applies to the outermost right hand midbass driver and Mixer 4×1_3 (not shown) and mixes down the four derived signals reproduced by its neighboring midbass driver.

FIG. 11 is a screen shot of the D2 DAE6 DSP signal flow for the applicant's Polk Audio SurroundBar 9500™ illustrating a second order low-pass filter (12 dB/octave) operating on the center channel program information directed to center-located midbass driver. Note that its nominal low-pass frequency is 3600 Hz, substantially higher than the LPF's operating on the outer midbass drivers. Above 3.6 kHz the center-located tweeter (high-frequency transducer) operates over the balance of the audible passband up to 20 kHz. Note further that Compressor 4, a parametric Dynamic Range Compressor (DRC) is that associated with this particular amplifier output channel (number 8 of the 10 utilized inputs of the Output block's 12 available inputs).

Persons of skill in the art will appreciate that the embodiments illustrated are exemplary, but not limiting. System 100 consists of a long (e.g., 44⅝" long) amplified bar enclosure 110 incorporating five 2½" convex drivers (e.g., 210, 212, 214, 216, 218) and three ½" silk dome tweeters 220, 222, 224), each driven by a dedicated amplifier channel (e.g., as illustrated in FIG. 6A). Powered wireless subwoofer 130 has an MDF cabinet with a down-firing 8" long throw composite cone with rubber surround (not shown). In OCA 150, crossover high and low pass filters are implemented electronically with no passive componentry in the signal path. This reduces phase shift and lowers distortion inherent in all passive crossover networks and the dedicated amplifiers for each of the eight drivers provide greater dynamic range, adding an effortless character that is appreciated as an enhanced sense of realism. Each channel's input signal is processed through OCA 150 which comprises a Digital Signal Processing ("DSP") engine programmed with 58 discrete DSP blocks for delay, frequency shaping, crossover points, signal mixing and parametric compression, as illustrated in FIGS. 7-11). Amplitude smoothing addresses even minor irregularities of all eight active drive units. Center channel and the remaining Left, Right and Surround channels are actively controlled to provide strong image localization cues and a greater sense of ambience and space for users in the listening space.

All five of the mid-bass 2½" drive units (e.g., 210, 212, 214, 216, 218) contribute to the center channel performance in an amplitude-tapered cascaded array design now called the Optimized Center Array "OCA" system and method. The OCA system includes a novel method for band-limiting each driver's contribution to the overall sound field. The system progressively low-passes the driver array's outer and inner driver pairs to mitigate undesirable constructive and destructive interference that otherwise would result in off-axis frequency response irregularities (i.e., comb-filtering "venetian blind" effects which alter vocal reproduction for different seating positions). The OCA system of the present invention controls off-axis amplitude response by appropriately limiting each mid-bass driver's passband for minimal interference for off-axis seating locations as follows: outer driver pair (210, 218) reproduce center channel information from 80-400 Hz (or, in the embodiment illustrated in FIG. 4, 80-450 Hz) and inner driver pair (212, 216) reproduce center channel information from 80-700 Hz while only the center driver 214 plays center channel program material through the upper midrange all the way up to its crossover point with the center tweeter 222 (e.g., 80 Hz-4 kHz). Meanwhile, the outer tweeters 220, 224 are also employed as "super tweeters" (6 kHz-20 kHz) for center channel material in addition to serving their primary duties in the reproduction of Front (FL/FR) and Surround (SL/SR) channels. To avoid unwanted localization, the outer tweeters' acoustic output is appropriately delayed.

In accordance with the present invention, OCA processing in system 100 results in an unprecedented clarity and intelligibility of center channel information over a very wide listening area. Even listeners far to the side hear vocal reproduction and other center information with similar tonal balance to on-axis listeners. Everyone hears natural sounding, clear dialog, musical instruments and center-channel effects that are firmly anchored to the display screen 300.

Figure 13:
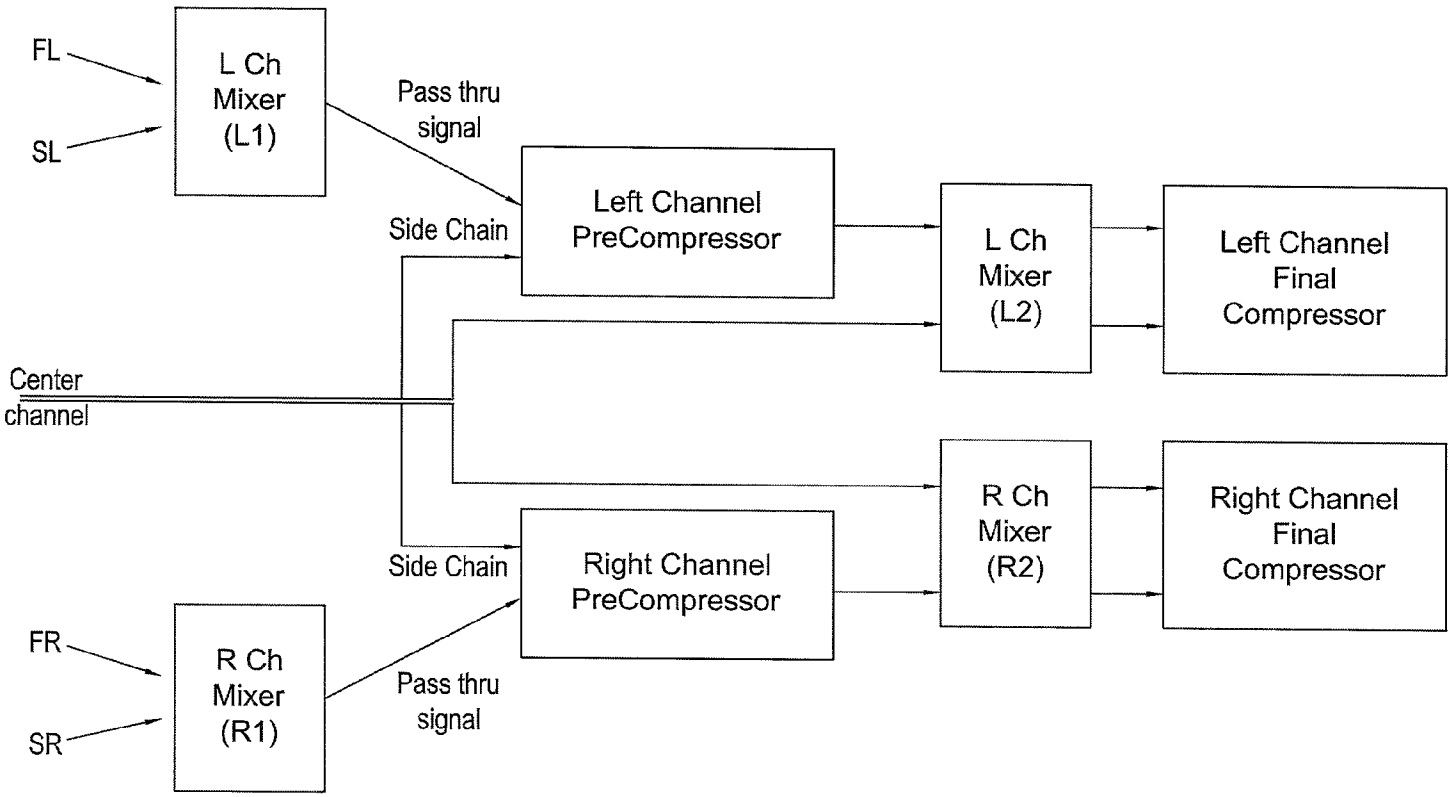
FIG. 13: is a diagram which illustrates, schematically, the auto suppression of front and surround channels for a user controllable "SPORTS" mode available with another embodiment of present invention.

Optional User Selectable Controls, "Voice Adjust" and "Sports Mode":

Turning now to FIGS. 12 and 13, a system (e.g. 100) may optionally include user controllable modes for enhancing center channel intelligibility and localization in a variety of specific modes. FIG. 12 is a screen shot illustrating exemplary DSP settings for a user controllable "VOICE ADJUST" mode, and FIG. 13 is a diagram which illustrates, schematically, auto suppression of front and surround channels for a user controllable "SPORTS" mode.

OCA 150 is optionally programmed to provide Dynamic DSP settings associated with a "Voice Adjust" (VA) feature, in response to a user input from a control button on enclosure 110 or from a user input provided on a remote control (not shown). Depending on the nature of the native program material being reproduced, it may be advantageous to attenuate master volume gain settings as a means of compensating for increasing center channel levels. More specifically, when the center channel is derived from the summation of front left and front right channels, overall sound levels (expressed in SPL dB-A or B-weighted) are significantly louder with increasing VA settings unless some means of compensation is implemented. Some combination of reduced master volume, which by definition affects the gain levels of all the discrete or derived components of a sound mix, or reduced FL and FR channels (post center channel derivation) effectively compensate for increased center channel, thereby increasing the relative center channel level within the overall sound mix for enhanced intelligibility of voice or other components of the center channel. However, when the center channel is a discrete component of a multichannel mix, such as Dolby Digital 5.1, DD 5.0 and other similar formats including competing ones from DTS (a popular, alternative multichannel audio decoder), there is no need to operate on master volume of FL/FR channels' gain settings as a means of compensating for increased VA settings since the center is discrete. FIG. 12 shows how compensatory changes in master volume for formats that require center channel derivation may be accomplished.

Furthermore, intelligibility may be enhanced by subtly boosting, within a limited range, some midrange components of the center channel with increasing VA settings. In a present embodiment, a single parametric EQ band centered at 1.5 kHz, 2.0 octaves wide (filter Q=0.667) serves to enhance voice intelligibility in combination with increased center channel levels within the sound mix. This parametric EQ must be limited in boost (or cut) magnitude in order to prevent undue, unnatural sounding spectral coloration, such as "shoutiness", in the presentation of center channel program, thereby preserving the desired clear natural sound reproduction. As shown in FIG. 12, the parametric EQ is limited in boost/cut to −2 dB/+3 dB as excessive magnitude shaping has been found to deleteriously affect spectral neutrality of the center channel.

Phantom Center Application

Many loudspeaker systems rely on only two output channels to reproduce as many six or eight discrete input channels that are "downmixed" accordingly. For such systems, the center channel is "phantom" (as opposed to relying on a dedicated loudspeaker channel) as the only two output channels in the system together reproduce the center channel. For such systems, voice intelligibility may be improved by boosting the center channel component within the sound mix while attenuating competing components (such as front and surround channels) even though there is no dedicated center channel loudspeaker channel.

"Sports" mode

Sports programming presents a special challenge for home theater loudspeaker systems and soundbars. Often, sports broadcasts are characterized by excessive crowd or game noises that compete with game calls by announcers and commentators, especially when they are located close to the event action. The system and method of the present invention lends itself to improving voice intelligibility by suppressing crowd and game play noises, most often mixed to the front and surround channels, and increasing the derived or discrete voice (center) channel within the sound mix. An automated, dynamic means of attenuating front and surround channels may utilize their associated compressors' "side chain" inputs. These channels will be suppressed within the overall sound mix by virtue of compression triggered in the presence of high center channel content in this manner. FIG. 13 shows a simplified implementation of this scheme, where Left and Right Channel Mixers L1 and R1 combine their associated channels' uncompressed front and surround channel data streams. Combined FL+SL is fed to pre-compressor whose side chain input (that to which the compressor's threshold responds) is the uncompressed center channel. Similarly, FR+SR is passed to a right channel pre-compressor whose side chain input is uncompressed center channel. The output of these compressors is mixed with uncompressed center channel to derive Left and Right output channel downmixes that are further processed in the "Final" compressor as appropriate for this host system. It should be noted that when center channel content is relatively low in level, which may occur often during a televised sporting event when the announcers are quiet for dramatic effect following an important moment of a game, the combined Front and Surround channels will be only minimally compressed during the pre-compression stage thereby preserving the intended drama conveyed by high-level crowd and game noises. Preferably, only when the announcers speak in the presence of high level front and surround channel content will such event ambient noises be suppressed in favor enhanced voice intelligibility.

Having described preferred embodiments of a new and improved system and method, it is believed that other modifications, variations and changes will be suggested to those skilled in the art in view of the teachings set forth herein. It is therefore to be understood that all such variations, modifications and changes are believed to fall within the scope of the present invention as defined in the appended claims.

What is claimed is:

1. A single enclosure multi-element loudspeaker line array audio reproduction system configured to provide enhanced Center Channel Performance, comprising:

(a) an audio reproduction system comprising: a first audio input signal, a second audio input signal, a third audio input signal, a fourth audio input signal and a fifth (center channel) audio input signal;

(b) a left main speaker and a right main speaker disposed respectively at left and right main speaker locations spaced along a speaker array axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers; a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations;

(c) a center front speaker located between the left and right main speaker locations at a midpoint of said speaker array axis, wherein said center front speaker reproduces sound associated with signals received by it; and means for transmitting said fifth audio input signal to said center front speaker; wherein sound reproduced by the system associated with said fifth audio input signal is perceived by a listener located in the listening area whose head is oriented generally toward the speaker locations to originate from approximately the location of said center front speaker;

(d) signal modification and combination means, wherein said signal modification and combination means comprises, means for modifying the first audio input signal and combining the modified first audio input signal with the second audio input signal and transmitting the combination of said modified first audio input signal and said second audio input signal to said left main speaker, means for modifying the fourth audio input signal and combining the modified fourth audio input signal with the third audio input signal and transmitting the combination of said modified fourth audio input signal and said third audio input signal to said right main speaker, means for subtracting said modified fourth audio input signal from said modified first audio input signal and transmitting the resulting difference signal to said left sub-speaker, and means for subtracting said modified first audio input signal from said modified fourth audio input signal and transmitting the resulting difference signal to said right sub-speaker, wherein sound reproduced by the system that is associated with said second and third audio input signals is perceived by a listener located in the listening area whose head is oriented generally toward the speaker locations to originate from a range of sound locations approximately between said left and right main speakers; and (e) wherein said signal modification and combination means further includes first bandpass filter means for modifying the fifth (center channel) audio input signal and transmitting the modified fifth (center channel) audio input signal to said left and right sub speakers, and wherein said signal modification and combination means further includes second bandpass filter means for modifying the fifth (center channel) audio input signal and transmitting the modified fifth (center channel) audio input signal to said left and right main speakers;

wherein the reproduced sound associated with said fifth (center channel) audio input signal when reproduced by said left and right sub speakers said left and right main speakers and said center front speaker is perceived by a listener located in the listening area whose head is oriented generally toward the speaker locations to originate from a sound location near said midpoint of said speaker array axis.

2. The single enclosure multi-element loudspeaker line array audio reproduction system of claim 1, wherein said first audio input signal, said second audio input signal, said third audio input signal, and said fourth audio input signal correspond to rear left, front left, front right, and rear right signals of a surround sound audio system.

3. The single enclosure multi-element loudspeaker line array audio reproduction system of claim 1, wherein the first bandpass filter means for modifying the fifth (center channel) audio input signal and transmitting the first bandpass modified fifth (center channel) audio input signal to said left and right sub speakers comprises a Low Pass Filter tuned to attenuate signals in the range of e.g., 250 Hz-1200 Hz, wherein said first sub-speaker selected LPF cutoff frequency is determined using the formulae: $f(d_{NC})=0.55c/d_{NC}$, where c is the speed of sound in air and $d_{NC}$ is the distance of the center of the laterally offset transducer of interest from the center of the sound bar.

4. The single enclosure multi-element loudspeaker line array audio reproduction system of claim 3, wherein the first bandpass filter means for modifying the fifth (center channel) audio input signal and transmitting the first bandpass modified fifth (center channel) audio input signal to said left and right sub speakers comprises a Low Pass Filter tuned to attenuate signals above 400 Hz.

5. The single enclosure multi-element loudspeaker line array audio reproduction system of claim 3, wherein the second bandpass filter means for modifying the fifth (center channel) audio input signal and transmitting the second bandpass modified fifth (center channel) audio input signal to said left and right main speakers comprises a Low Pass Filter tuned to attenuate signals at a second main speaker selected LPF cutoff frequency in the range of e.g., 250 Hz-1200 Hz, wherein said second, main speaker selected LPF cutoff frequency is determined using the formulae: $f(d_{NC})=0.55c/d_{NC}$, where c is the speed of sound in air and $d_{NC}$ is the distance of the center of the laterally offset main speaker from the center of the sound bar.

6. The single enclosure multi-element loudspeaker line array audio reproduction system of claim 5, wherein the second bandpass filter means for modifying the fifth (center channel) audio input signal and transmitting the second bandpass modified fifth (center channel) audio input signal to said left and right main speakers comprises a Low Pass Filter tuned to attenuate signals above 700 Hz.

7. The single enclosure multi-element loudspeaker line array audio reproduction system of claim 1, wherein the left and right sub-speakers are located to the left and right respectively of the respective left and right main speaker locations and are spaced a distance d from the respective left and right main speaker locations such that the distance d is in the range from approximately 50% to 150% of an average spacing between a person's ears as measured in a straight line through the head, wherein said left and right sub-speakers reproduce sound associated with signals received by them; and wherein said signal modification and combination means comprises, means for modifying the first audio input signal and combining the modified first audio input signal with the second audio input signal and transmitting the combination of said modified first audio input signal and said second audio input signal to said left main speaker, means for modifying the fourth audio input signal and combining the modified fourth audio input signal with the third audio input signal and transmitting the combination of said modified fourth audio input signal and said third audio input signal to said right main speaker, means for subtracting said modified fourth audio input signal from said modified first audio input signal and transmitting the resulting difference signal to said left sub-speaker, and means for subtracting said modified first audio input signal from said modified fourth audio input signal and transmitting the resulting difference signal to said right sub-speaker, wherein sound reproduced by the system that is associated with said second and third audio input signals is perceived by a listener located in the listening area whose head is oriented generally toward the speaker locations to originate from a range of sound locations approximately between said left and right main speakers, and wherein sound reproduced by the system that is associated with said first and fourth audio input signals is perceived by a listener located in the listening area whose head is oriented generally toward the speaker locations to originate from a broad range of sound locations extending beyond the locations of said left and right sub-speakers.

8. The single enclosure multi-element loudspeaker line array audio reproduction system of claim 7, wherein the distance d between said respective main and sub-speakers is approximately equal to the average ear spacing.

9. The single enclosure multi-element loudspeaker line array audio reproduction system of claim 7, wherein said signal modification and combination means further includes a first front-to-back filter for modifying the first audio input signal and a second front-to-back filter for modifying the fourth audio input signal such that the reproduced sound associated with said first and fourth audio input signals is perceived by a listener located in the listening area whose head is oriented generally toward the speaker locations to originate from a broad range of sound locations extending beyond the locations of said left and right sub-speakers including areas behind the listener.

10. The single enclosure multi-element loudspeaker line array audio reproduction system of claim 9, wherein the first and second front-to-back filters are band limited to below approximately 2,500 Hz.

11. The single enclosure multi-element loudspeaker line array audio reproduction system of claim 10, wherein the first and second front-to-back filters include band emphasis at approximately 12 kHz.

12. The single enclosure multi-element loudspeaker line array audio reproduction system of claim 7, wherein the signal modification and combination means further includes a first low-pass filter for modifying the portion of the modified first audio input signal transmitted to the left sub-speaker and a second low-pass filter for modifying the portion of the modified fourth audio input signal transmitted to the right sub-speaker, wherein the apparent sound locations of sound reproduced by the system associated with said first and fourth audio input signals are perceived by a listener located in the listening area to be more stable and more tolerant of movements of the listener's head.

13. The single enclosure multi-element loudspeaker line array audio reproduction system of claim 12, wherein said first and second low-pass filters limit frequency response to below approximately 5 kHz.

14. A method for optimizing center channel performance in a high performance single enclosure home theater loudspeaker system, comprising:

(a) providing an elongated enclosure configured to support and aim a multi-element loudspeaker line array, said enclosure being configured to enclose and support an audio reproduction system including: a first audio input signal, a second audio input signal, a third audio input signal, a fourth audio input signal and a fifth (center channel) audio input signal;

(b) providing a left main speaker and a right main speaker disposed respectively at left and right main speaker locations spaced along a speaker array axis defined as a line passing through said left and right main speaker locations, with a listening area comprising the general area in front of the left and right main speaker locations such that the left main speaker location lies to the left and the right main speaker location lies to the right when viewed from the listening area, wherein said left and right main speakers reproduce sound associated with signals received by said left and right main speakers; a left sub-speaker and a right sub-speaker disposed respectively at left and right sub-speaker locations, wherein the left and right sub-speaker locations lie approximately on the speaker axis such that the left and right sub-speaker locations as viewed from the listening area are located to the left and right respectively of the respective left and right main speaker locations;

(c) providing a center front speaker located between the left and right main speaker locations at a midpoint of said speaker array axis, wherein said center front speaker reproduces sound associated with signals received by it; and means for transmitting said fifth audio input signal to said center front speaker; wherein sound reproduced by the system associated with said fifth audio input signal is perceived by a listener located in the listening area whose head is oriented generally toward the speaker locations to originate from approximately the location of said center front speaker;

(d) providing signal modification and combination means which are responsive to said first, second, third, fourth and fifth audio input signals;

(e) modifying the first audio input signal and combining the modified first audio input signal with the second audio input signal and transmitting the combination of said modified first audio input signal and said second audio input signal to said left main speaker;

(f) modifying the fourth audio input signal and combining the modified fourth audio input signal with the third audio input signal and transmitting the combination of said modified fourth audio input signal and said third audio input signal to said right main speaker;

(g) subtracting said modified fourth audio input signal from said modified first audio input signal and transmitting the resulting difference signal to said left sub-speaker, and (h) subtracting said modified first audio input signal from said modified fourth audio input signal and transmitting the resulting difference signal to said right sub-speaker, wherein sound reproduced by the system that is associated with said second and third audio input signals is perceived by a listener located in the listening area whose head is oriented generally toward the speaker locations to originate from a range of sound locations approximately between said left and right main speakers;

(i) modifying the fifth (center channel) audio input signal with a first bandpass filtration and transmitting a first bandpass modified fifth (center channel) audio input signal to said left and right sub speakers, (j) modifying the fifth (center channel) audio input signal with a second bandpass filtration and transmitting a second bandpass modified fifth (center channel) audio input signal to said left and right main speakers;

(k) reproducing sound associated with said fifth (center channel) audio input signal simultaneously through said left and right sub speakers, said left and right main speakers and said center front speaker so that said reproduced center channel sound is perceived by the listener located in the listening area to originate from a sound location near said midpoint of said speaker array axis.

15. The method for optimizing center channel performance of claim 14, wherein the first bandpass filter modifies the fifth (center channel) audio input signal and transmits the modified fifth (center channel) audio input signal to said left and right sub speakers wherein said first bandpass filter comprises a Low Pass Filter tuned to attenuate signals above a first sub-speaker selected LPF cutoff frequency in the range of 250 Hz-1200 Hz, wherein said first sub-speaker selected LPF cutoff frequency is determined using the formulae: $f(d_{NC})=0.55c/d_{NC}$, where c is the speed of sound in air and $d_{NC}$ is the distance of the center of the laterally offset sub-speaker of interest from the center of the sound bar.

16. The method for optimizing center channel performance of claim 15, wherein the second bandpass filter modifies the fifth (center channel) audio input signal and transmits the modified fifth (center channel) audio input signal to said left and right main speakers, wherein said second bandpass filter comprises a Low Pass Filter tuned to attenuate signals in the range of e.g., 250 Hz-1200 Hz, wherein said second, main speaker selected LPF cutoff frequency is determined using the formulae: $f(d_{NC})=0.55c/d_{NC}$, where c is the speed of sound in air and $d_{NC}$ is the distance of the center of the laterally offset main speaker of interest from the center of the sound bar.

17. The method for optimizing center channel performance of claim 15, wherein the second bandpass filter modifies the fifth (center channel) audio input signal and transmits the modified fifth (center channel) audio input signal to said left and right main speakers, wherein said second bandpass filter comprises a Low Pass Filter tuned to attenuate signals above 700 Hz.

18. The method for optimizing center channel performance of claim 14, wherein the first bandpass filter modifies the fifth (center channel) audio input signal and transmits the modified fifth (center channel) audio input signal to said left and right sub speakers wherein said first bandpass filter comprises a Low Pass Filter tuned to attenuate signals above 400 Hz.

19. The method for optimizing center channel performance of claim 14, further comprising:

(l) providing a user controllable input to actuate a "sports mode";

(m) in response to actuation of "sports mode", suppressing crowd and game play noises, most often mixed to the front and surround channels, and increasing the voice (center) channel signal in relation to the other channel signals in a program's sound mix.

20. The method for optimizing center channel performance of claim 19, wherein step (m) further comprises programming an automated, dynamic means of attenuating front and surround channels which optionally include associated compressors with "side chain" inputs, and wherein said front and surround channels are suppressed within the overall sound mix by virtue of compression triggered in the presence of high center channel content.

* * * * *